US010487440B2

(12) United States Patent
Jung

(10) Patent No.: US 10,487,440 B2
(45) Date of Patent: Nov. 26, 2019

(54) LAUNDRY TREATMENT APPARATUS

(71) Applicant: LG ELECTRONICS INC., Seoul (KR)

(72) Inventor: Seungbae Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 247 days.

(21) Appl. No.: 15/197,379

(22) Filed: Jun. 29, 2016

(65) Prior Publication Data

US 2017/0002504 A1 Jan. 5, 2017

(30) Foreign Application Priority Data

Jun. 30, 2015 (KR) ..... 10-2015-0092785

(51) Int. Cl.

| | |
|---|---|
| ***D06F 39/12*** | (2006.01) |
| ***D06F 29/00*** | (2006.01) |
| ***D06F 37/02*** | (2006.01) |
| ***D06F 37/28*** | (2006.01) |
| *D06F 39/00* | (2006.01) |

(52) U.S. Cl.

CPC ..... *D06F 39/12* (2013.01); *D06F 29/00* (2013.01); *D06F 37/02* (2013.01); *D06F 37/28* (2013.01); *D06F 39/005* (2013.01)

(58) Field of Classification Search

CPC ..... D06F 39/12; D06F 39/005; D06F 29/00; D06F 29/005; D06F 37/28; D06F 2210/00; D06F 2214/00

See application file for complete search history.

(56) References Cited

U.S. PATENT DOCUMENTS 4,510,778 A * 4/1985 Cotton ..... D06F 33/02 68/12.15
5,926,886 A * 7/1999 Braunschweig ..... D06F 29/00 68/19.2

(Continued)

FOREIGN PATENT DOCUMENTS

CN 1648320 8/2005
CN 101139791 3/2008

(Continued)

OTHER PUBLICATIONS

Taiwan Office Action in Taiwan Application No. 105118839, dated Jun. 26, 2017, 8 pages (with English translation).

(Continued)

*Primary Examiner* — David G Cormier
(74) *Attorney, Agent, or Firm* — Fish & Richardson P.C.

(57) ABSTRACT

Disclosed is a laundry treatment apparatus including a first cabinet, a first drum provided inside the first cabinet for receiving laundry therein, a first drive unit for rotating the first drum, a first controller for controlling the first drive unit, a second cabinet located under the first cabinet and having an introduction/discharge opening, a drawer provided so as to be discharged from the second cabinet through the introduction/discharge opening, a second drum provided inside the drawer for receiving laundry therein, a second drive unit for rotating the second drum, a second controller for controlling the second drive unit, and a remote controller for transmitting a control signal to the second controller via wireless communication.

17 Claims, 4 Drawing Sheets

(56) References Cited

U.S. PATENT DOCUMENTS

| | | | | |
|---|---|---|---|---|
| 8,091,389 | B2 * | 1/2012 | Park | D06F 29/00 68/19.1 |
| 2004/0118008 | A1 * | 6/2004 | Jeong | D06F 58/28 34/425 |
| 2006/0150689 | A1 | 7/2006 | Kim et al. | |
| 2007/0249212 | A1 * | 10/2007 | Buecker | D06F 39/005 439/369 |
| 2007/0266743 | A9 | 11/2007 | Sunshine et al. | |
| 2008/0053163 | A1 | 3/2008 | Park et al. | |
| 2009/0057527 | A1 | 3/2009 | Jo | |
| 2009/0145175 | A1 | 6/2009 | Kim et al. | |
| 2010/0011609 | A1 * | 1/2010 | Park | D06F 58/10 34/88 |
| 2013/0156435 | A1 * | 6/2013 | Hsieh | G08C 23/04 398/106 |
| 2014/0033772 | A1 * | 2/2014 | Jung | D06F 37/145 68/131 |
| 2014/0313019 | A1 * | 10/2014 | Chang | H04B 1/0346 340/12.55 |

FOREIGN PATENT DOCUMENTS

| | | |
|---|---|---|
| CN | 101407990 | 4/2009 |
| CN | 101529009 | 9/2009 |
| CN | 101974838 | 2/2011 |
| CN | 102191653 | 9/2011 |
| EP | 1548174 | 6/2005 |
| JP | H05-293293 | 11/1993 |
| KR | 10-2005-0115970 | 12/2005 |
| KR | 10-0717458 | 5/2007 |
| KR | 10-2009-0052458 | 5/2009 |
| KR | 10-2013-0024369 | 3/2013 |
| KR | 101319875 | 10/2013 |

OTHER PUBLICATIONS

International Search Report and Written Opinion in International Application No. PCT/KR2016/006965, dated Sep. 12, 2016, 12 pages.

Chinese Office Action in Chinese Application No. 201610511494.9, dated Feb. 5, 2018, 15 pages (with English translation).

* cited by examiner

[FIG. 1]
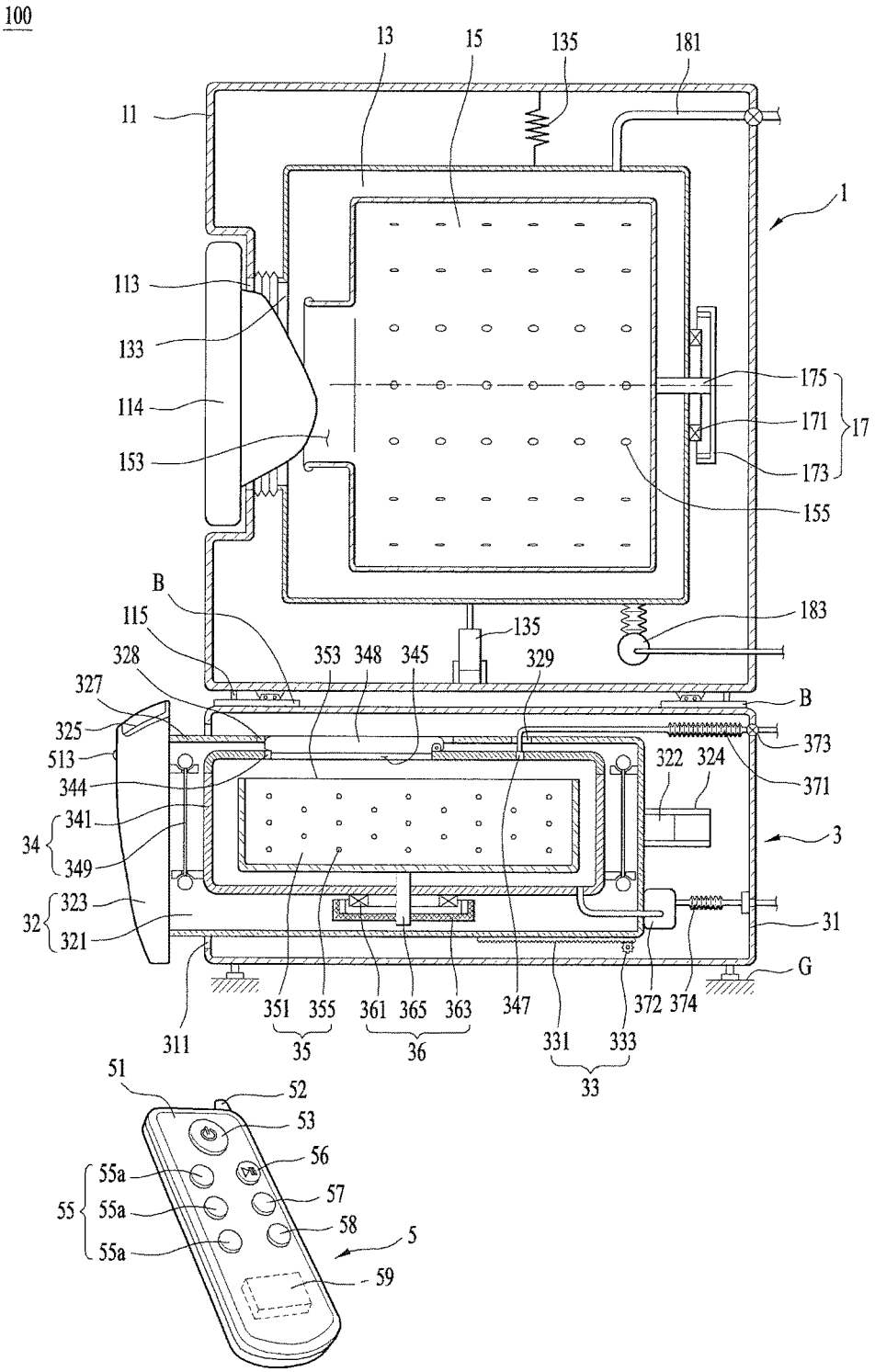

[FIG.2]
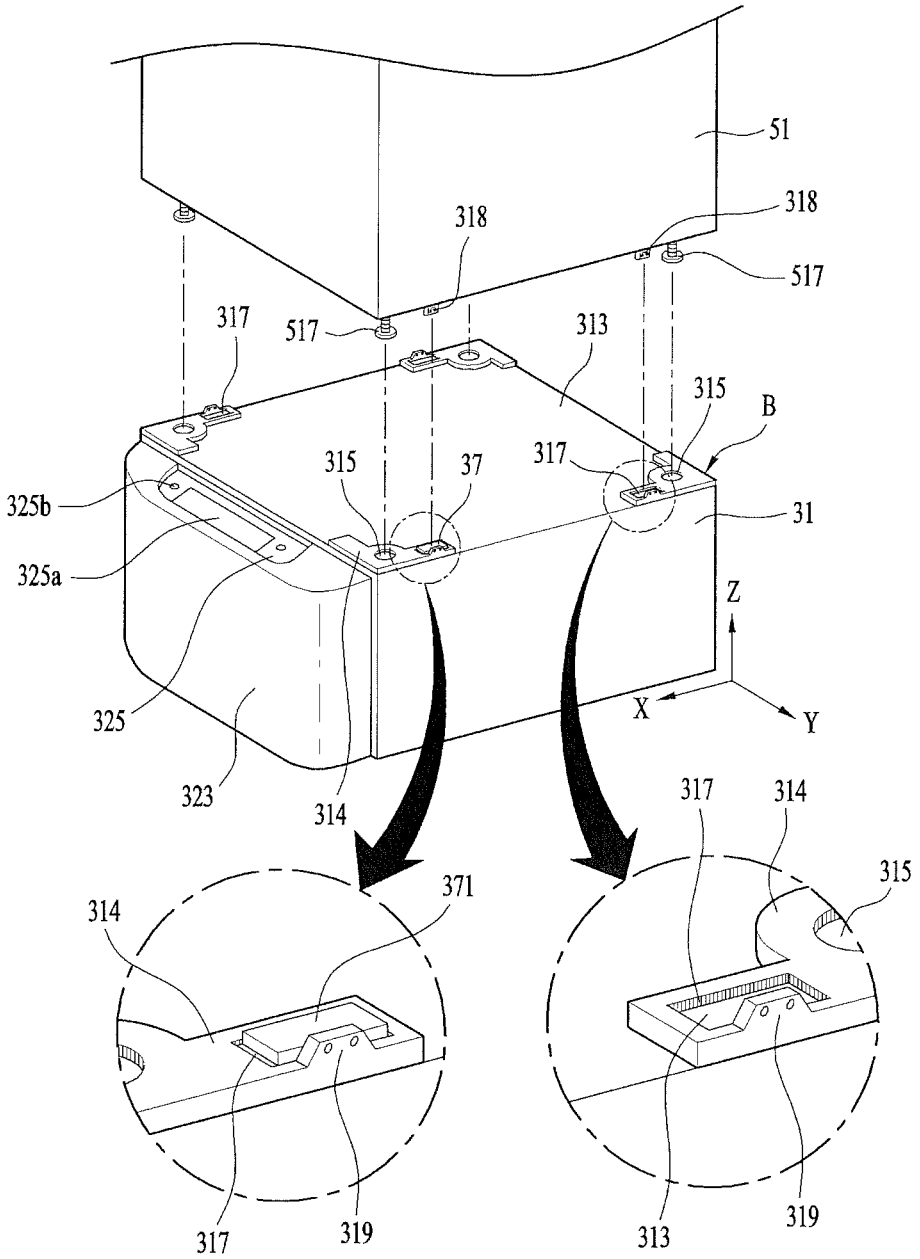

[FIG. 3]
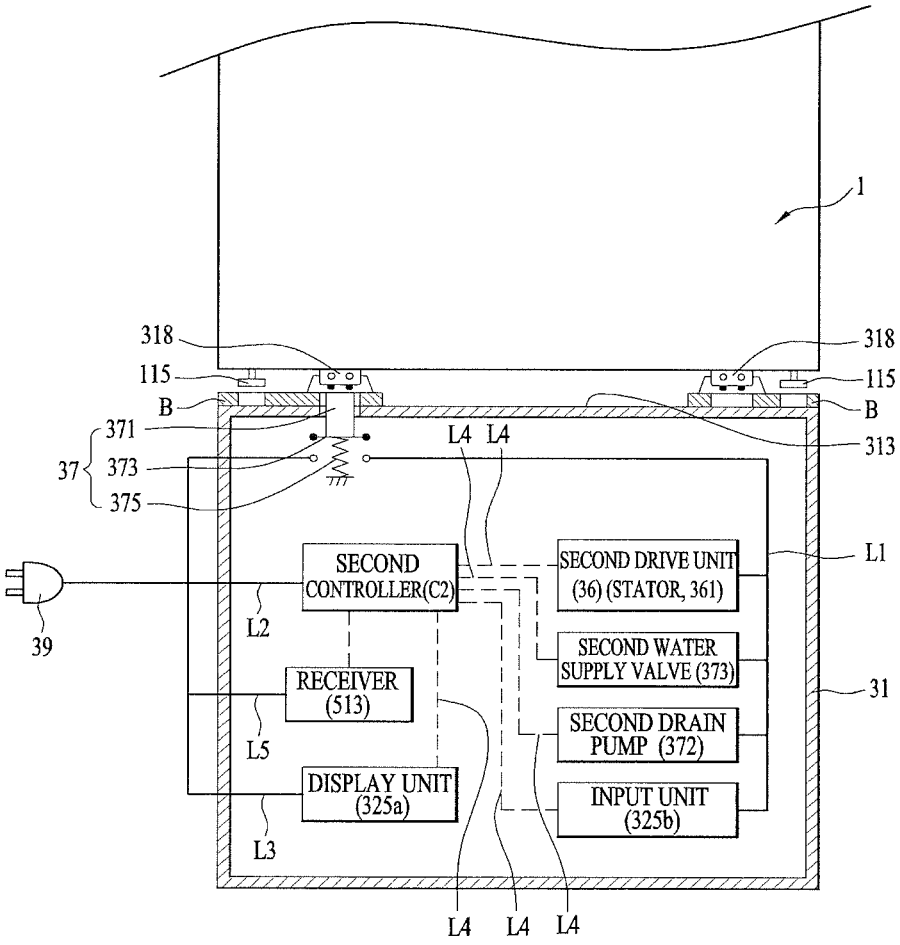

LAUNDRY TREATMENT APPARATUS

CROSS-REFERENCE TO RELATED APPLICATION

This application claims the benefit of Korean Patent Application No. 10-2015-0092785, filed on Jun. 30, 2015, which is hereby incorporated by reference as if fully set forth herein.

BACKGROUND

The present disclosure relates to a laundry treatment apparatus.

Generally, a laundry treatment apparatus is a generic term for an apparatus that washes laundry (i.e. objects to be washed or objects to be dried), an apparatus that dries laundry, and an apparatus that may perform both washing and drying of laundry.

Conventional laundry treatment apparatuses are classified into front loading type laundry treatment apparatuses configured so that laundry is introduced through an opening formed in the front surface of the apparatus, and top loading type laundry treatment apparatuses configured so that laundry is introduced through an opening formed in the upper surface of the apparatus.

Meanwhile, conventional laundry treatment apparatuses face a limitation as to the ability to reduce the volume thereof because they need to be designed so as to treat (i.e. wash or rinse) at least a given amount of laundry.

Because it is difficult to reduce the volume of the laundry treatment apparatus, a user who uses two laundry treatment devices need to arrange the two laundry treatment devices beside each other on the ground surface in order to use them, which deteriorates the availability of space in which to install the laundry treatment devices.

SUMMARY

Accordingly, the present invention is directed to a laundry treatment apparatus that substantially obviates one or more in problems due to limitations and disadvantages of the related art.

One object of the present invention is to provide a laundry treatment apparatus in which a plurality of treatment devices each having a laundry treatment function (e.g. washing of laundry or drying of laundry) are stacked one above another so as to realize a complex laundry treatment function.

In addition, another object of the present invention is to provide a laundry treatment apparatus in which a plurality of treatment devices are stacked one above another in such a manner that any one treatment device absorbs vibration generated in another treatment device, thereby minimizing vibration and noise.

In addition, another object of the present invention is to provide a laundry treatment apparatus in which a plurality of treatment devices are stacked one above another to realize a complex function, at least one of the treatment devices being remote-controllable.

In addition, a further object of the present invention is to provide a laundry treatment apparatus in which a plurality of laundry treatment devices are stacked one above another to realize a complex function, the laundry treatment apparatus being capable of controlling, for example, a command to operate a drawer provided in a lower treatment device and a command to open and close a door from a remote place.

To achieve these objects and other advantages and in accordance with the purpose of the invention, as embodied and broadly described herein, in accordance with an aspect of the present invention, a laundry treatment apparatus includes a first cabinet, a first drum provided inside the first cabinet for receiving laundry therein, a first drive unit for rotating the first drum, a first controller for controlling the first drive unit, a second cabinet located under the first cabinet and having an introduction/discharge opening, a drawer provided so as to be discharged from the second cabinet through the introduction/discharge opening, a second drum provided inside the drawer for receiving laundry therein, a second drive unit for rotating the second drum, a second controller for controlling the second drive unit, and a remote controller for transmitting a control signal to the second controller via wireless communication.

The drawer may include a drawer panel for opening and closing the introduction/discharge opening and a drawer body, to which the drawer panel is fixed, the drawer body being configured so as to be discharged from the second cabinet through the introduction/discharge opening, and the remote controller may include a body, a transmitter provided in the body for transmitting the control signal, and a receiver provided in the drawer panel for receiving the control signal.

The receiver may be provided on a front surface of the drawer panel or an upper surface of the drawer panel.

The drawer may include a drawer panel for opening and closing the introduction/discharge opening and a drawer body, to which the drawer panel is fixed, the drawer body being configured so as to be discharged from the second cabinet through the introduction/discharge opening, and the remote controller may include a body, a transmitter provided in the body for transmitting the control signal, and a receiver provided in the drawer body for receiving the control signal.

The laundry treatment apparatus may further include a window provided on an upper surface of the drawer body for transmitting light into the drawer, and the receiver may be located under the window.

The laundry treatment apparatus may further include a fixing unit for separably coupling the remote controller to the first cabinet or the second cabinet.

At least one of the first cabinet and the second cabinet may be formed of a metal, and the fixing unit may be configured as a permanent magnet.

The laundry treatment apparatus may further include a discharge unit for moving the drawer to an outside of the second cabinet or an inside of the second cabinet, and a discharge controller provided in the remote controller for controlling whether or not to operate the discharge unit.

The laundry treatment apparatus may further include a door for opening and closing an introduction opening, through which laundry is supplied to the second drum, a door lock for fixing the door to the introduction opening, and a lock controller provided in the remote controller for controlling whether or not to operate the door lock.

The laundry treatment apparatus may further include a connector for allowing the second controller to control an operation of the second drive unit only when the first cabinet is seated on an upper surface of the second cabinet.

The connector may open or close a circuit for supplying power to the second drive unit based on whether the first cabinet is located above the second cabinet.

The laundry treatment apparatus may further include a first connection piece provided on a bottom surface of the first cabinet, and a second connection piece provided on the upper surface of the second cabinet so as to be separably coupled to the first connection piece, and the connector may include a connector body penetrating the upper surface of the second cabinet so that the first connection piece applies a pressure to the connector body, and a circuit connection piece for opening or closing a circuit, which supplies power to the second drive unit, based on a position of the connector body.

The laundry treatment apparatus may further include a second treatment device power line for connecting a power source and the circuit, which supplies power to the second drive unit, to each other, and a display unit for receiving power from the second treatment device power line, and the second controller, the display unit, and the receiver may be provided so as to receive power regardless of whether or not the first cabinet is located above the second cabinet.

The second controller may notify a user of a state in which the circuit, which supplies power to the second drive unit, is opened via the display unit when the receiver receives the control signal in a state in which no power is supplied to the second drive unit.

The connector may open or close a control circuit, which connects the second controller and the second drive unit to each other, based on whether or not the first cabinet is located above the second cabinet.

The subject matter described in this specification may include implementations that realize one or more of the following advantages. For instance, a laundry treatment apparatus includes multiple laundry treatment devices. Each of the multiple laundry treatment devices can determine whether one laundry treatment device is coupled with another treatment device. Based on this determination, each of the multiple laundry treatment devices can control operations of laundry treatment. Thus, the laundry treatment apparatus may efficiently control each of the multiple laundry treatment devices.

BRIEF DESCRIPTION OF THE DRAWINGS

FIG. 1 is a diagram illustrating an example laundry treatment apparatus.

FIGS. 2 and 3 are diagrams illustrating an example connector.

Like reference numbers and designations in the various drawings indicate like elements.

DETAILED DESCRIPTION

Figure 4A:
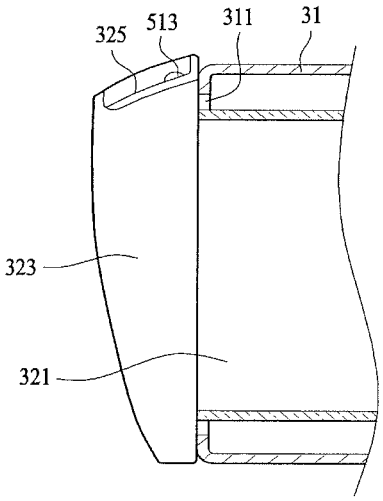
FIGS. 4(*a*) and 4(*b*) are diagrams illustrating example receivers.

FIG. 1 illustrates an example laundry treatment apparatus. A laundry treatment apparatus 100 includes a first treatment device 1 and a second treatment device 3. The first treatment device 1 and the second treatment device 3 may be controlled using a remote controller 5.

The first treatment device 1 and the second treatment device 3 can be a laundry treatment machine including a washing machine or a dryer. For example, the first treatment machine 1 can be a washing machine and the second treatment machine 3 can be a dryer. For another example, both the first treatment device 1 and the second treatment device 3 can be a washing machine or a dryer. Any combination of a laundry treatment device can be used for the laundry treatment apparatus including the first treatment device 1 and the second treatment device.

The first treatment device 1 may include a first cabinet 11, a first tub 13 provided inside the first cabinet 11 for storing water therein, a first drum 15 provided inside the first tub 13 for receiving laundry therein, and a first drive unit 17 for rotating the first drum 15.

The first cabinet 11 has a first introduction opening 113 for supplying laundry to the first drum 15 or discharging laundry stored in the first drum 15 to the outside. The first introduction opening 113 is opened and closed by a door 114 (i.e. a first treatment device door) rotatably provided at the first cabinet 11.

A height adjustment unit 115 may be provided underneath the bottom surface of the first cabinet 11. The height adjustment unit 115 may serve to cause the first cabinet 11 to be supported on the upper surface of the second treatment device 3. The user may adjust the height or balance of the first cabinet 11 using the height adjustment unit 115.

The first tub 13 may have any shape so long as it can store water. The first tub 13 receives water from a first water supply unit 181 and discharges the water to the outside of the first cabinet 11 via a first drain unit 183.

The first tub 13 may have a first tub opening 133 for communicating with the first introduction opening 113, and a first tub support unit 135 for fixing the first tub 13 inside the first cabinet 11. The first tub support unit 135 may be provided so as to absorb vibration generated in the first tub 13.

The first drum 15 is located inside the first tub 13 so as to provide a space in which laundry is received, and may be rotated inside the first tub 13 by the first drive unit 17. The first drum 15 may have a first drum opening 153 for communicating with the first tub opening 133 and the first introduction opening 113. Holes 155 may be provided in the peripheral surface of the first drum 15 (in the circumferential surface and the rear surface) for communicating the first tub 13 with the inside of the first drum 15.

The first drive unit 17 may include a stator 171 fixed to the outer bottom surface of the first tub 13 for generating a rotating magnetic field, a rotor 173 configured so as to be rotated by the rotating magnetic field, and a first drum rotating shaft 175 penetrating the bottom surface of the first tub 13 for connecting the rotor 173 and the first drum 15 to each other.

In the first treatment device 1 having the configuration described above, a first treatment device controller supplies water to the first tub 13 via the first water supply unit 181, and thereafter rotates the first drum 15 using the first drive unit 17 so as to wash laundry. Thereafter, the first controller discharges the water to the outside of the first tub 13 from the first drain unit 183, and thereafter rotates the first drum 15 using the first drive unit 17 so as to dehydrate laundry.

The second treatment device 3 may include a second cabinet 31 located under the first treatment device 1, a drawer 32 configured so as to be discharged from the second cabinet 31, a second tub 34 located inside the drawer 32 for storing water therein, and a second drum 35 provided inside the second tub 34 for storing laundry therein.

The second cabinet 31 has an introduction/discharge opening 311 formed in the front surface thereof. The drawer 32 may be discharged from or inserted into the second cabinet 31 through the introduction/discharge opening 311.

The drawer 32 includes a drawer body 321 having an open upper surface, and a drawer cover 327 provided in the open surface of the drawer body 321 so as to define the upper surface of the drawer body 321.

The drawer body 321 may be coupled to the second cabinet 31 so as to be discharged therefrom via a rail 322 and a rail support member 324. The rail support member 324 may be fixed to the second cabinet 31, and the rail 322 may be fixed to the drawer body 321 so as to be discharged from the rail support member 324.

A drawer panel 323 may be provided on the front surface of the drawer body 321. The drawer panel 323 may serve as a handle for opening and closing the introduction/discharge opening 311 and for discharging or inserting the drawer body 321 from or into the second cabinet 31.

That is, the user may pull the drawer panel 323 so as to discharge the drawer body 321 from the second cabinet 31, and may push the drawer panel 323 so as to insert the drawer body 321 into the second cabinet 31.

In some implementations, the drawer body 321 may be discharged from or inserted into the second cabinet 31 using a discharge unit 33. For example, the discharge unit 33 may include a rack 331 provided on the bottom surface of the drawer body 321, and a pinion 333 coupled to the rack 331 so as to be rotated by a motor.

The drawer panel 323 may be provided with a second treatment device control panel 325 (i.e. a second control panel). The second control panel 325 includes a device for controlling, for example, a second water supply unit, a second drain unit, and a second drive unit, which will be described below (i.e. a second treatment device controller or a second controller).

FIG. 2 illustrates an example connector. In FIG. 2, the second control panel 325 may include an input unit 325*b* for allowing the user to input a control command to the second treatment device 3, and a display unit 325*b* for notifying the user of a control command input using the input unit 325*b*, or the process of execution of a control command input by the user.

Referring back to FIG. 1, the drawer cover 327 may have a first hole 328 and a second hole 329 formed in the drawer cover 327 for communicating the inside of the drawer body 321 with the outside of the drawer body 321. The functions of the first hole 328 and the second hole 329 will be described below.

The second tub 34 may include a second tub body 341 connected to the drawer 32 via a second tub support unit 349. The second tub body 341 has an introduction opening 345 (i.e. a second introduction opening) formed in the upper surface thereof for communicating the inside of the second tub body 341 with the outside. The second introduction opening 345 is opened and closed by a door 348 (i.e. a second treatment device door).

The tub body 341 may include a door lock 344 for fixing the second treatment device door 348 to the second introduction opening 345. Although the door lock 344 may have any shape or configuration capable of fixing the second treatment device door 348 to the second introduction opening 345, the door lock 344 may serve to fix the second treatment device door 348 to the second introduction opening 345 or to separate the second treatment device door 348 from the second introduction opening 345 under the control of the second controller.

Because the second introduction opening 345 is located under the first hole 328, the second door 348 may be rotated and moved to the outside of the drawer 32 through the first hole 328 provided in the drawer cover 327. Accordingly, the user may introduce laundry into the second drum 35 by opening the second treatment device door 348 after discharging the drawer 32 from the second cabinet 31.

In some implementations, the second tub 34 is further provided in the upper surface thereof with a supply aperture 347 connected to a water supply pipe 371. The water supply pipe 371 serves to connect a water supply source and the supply aperture 347 to each other, and is inserted into the drawer 32 through the second hole 329 provided in the drawer cover 327.

The second drum 35 may include a cylindrical second drum body 351, a second drum introduction opening 353 provided in the upper surface of the second drum body 351, and a plurality of holes 355 formed in the second drum body 351.

Because the second drum introduction opening 353 is located under the second introduction opening 345, the second drum introduction opening 353 serves as a passage, through which laundry is supplied to the second drum body 351, and the holes 355 serve as passages, through which water inside the second tub body 341 is introduced into the second drum body 351.

The second drum body 351 may be rotated by a second drive unit 36. The second drive unit 36 may include a stator 361 fixed to the second tub 34 for generating a rotating magnetic field, a rotor 363 configured so as to be rotated by the rotating magnetic field, and a second drum rotating shaft 365 penetrating the second tub 34 for connecting the bottom surface of the second drum body 351 and the rotor 363 to each other. As illustrated in the drawing, the second drum rotating shaft 365 may be provided so as to be orthogonal to the bottom surface of the drawer 32.

The second tub 34 receives water from the second water supply unit and discharges the water to the outside via the second drain unit. The second water supply unit may include the water supply pipe 371 for connecting the water supply source and the supply aperture 347 to each other, and a water supply valve 373 for opening and closing the water supply pipe 371 by the second treatment device controller C2, i.e., the second controller as referred in FIGS. 4(*a*) and 4(*b*).

The second drain unit may include a drain pipe 374 for guiding water inside the second tub 34 to the outside of the second cabinet 31, and a drain pump 372 for discharging water inside the second tub 34 in response to a control signal of the second controller.

In some implementations, because the drawer 32 provided in the second treatment device 3 needs to be discharged from the second cabinet 31, the water supply pipe 371 and the drain pipe 374 may have a flexible configuration, or may be formed of an elastic material.

When the first drum 15 is rotated to wash laundry, vibration may occur in the first cabinet 11. As the magnitude of vibration generated in the first cabinet 11 increases, the first treatment device 1 may fall from the second treatment device 3. To prevent the falling, the first treatment device 1 can be coupled with the second treatment device 3 using a cabinet fastener B.

The cabinet fastener B serves to couple the first treatment device 1 to the second treatment device 3. When the first treatment device 1 is coupled to the second treatment device 3 using the cabinet fastener B, the first treatment device 1 may not fall from the second treatment device 3.

In addition, because the first treatment device 1, which is seated on the top of the second cabinet 31, may serve to absorb or limit vibration generated in the second treatment device 3, this example may minimize vibration of the second treatment device 3 via the cabinet fastener B.

In some implementations, when the drawer 32 is discharged from the second cabinet 31 in the state in which the first treatment device 1 is not present above the second treatment device 3, it is assumed that the center of gravity of the second treatment device 3 moves forward from the second cabinet 31. Therefore, there is the risk of the rear end of the second treatment device 3 being separated from the ground surface. Accordingly, the cabinet fastener B serves to prevent the rear surface of the second treatment device 3 from being separated from the ground surface when the drawer 32 is discharged from the second cabinet 31.

Referring to FIG. 2, the cabinet fastener B may include a first connection piece 318 provided at the first cabinet 11, a fastener body 314 fixed on an upper surface 313 of the second cabinet 31, and a second connection piece 319 provided on the fastener body 314 so as to be coupled to the first connection piece 318.

In some implementations, when the height adjustment unit 115 is provided on the bottom surface of the first treatment device 1, the cabinet fastener B may further include an adjustment unit receiving portion 315 in which the height adjustment unit 115 is received.

The adjustment unit receiving portion 315 may be a recess formed in the surface of the fastener body 314, or may be a hole formed in the fastener body 314.

Because the above-described effects by the cabinet fastener B cannot be achieved when the user separates the first treatment device 1 from the second treatment device 3, the laundry treatment apparatus 100 may further include a connector 37 for allowing the second treatment device 3 to be operated only when the first treatment device 1 is located above the second treatment device 3.

FIG. 3 illustrates an example connector. In FIG. 3, the connector 37 may be provided so as to open or close a first circuit L1, which supplies power to, for example, some elements 361, 373, 372 and 325*b* that require the supply of power among the constituent elements of the second treatment device 3.

The first circuit L1 may be connected to a power source via a second power line 39 (i.e. a second treatment device power line). The first circuit L1 may be a circuit for supplying power to the elements 361, 373, 372 and 325*b*. The first circuit L1 may be configured not to provide power to the second controller C2 and the display unit 325*a*. For example, the second controller C2 may continuously receive power via a second circuit L2, and the display unit 325*a* may continuously receive power via a third circuit L3.

In this example, the connector 37 closes the first circuit L1 when the first treatment device 1 is seated on the upper surface 313 of the second treatment device 3, and opens the first circuit L1 when the first treatment device 1 is separated from the upper surface 313 of the second treatment device 3 by way of example.

The connector 37 may include a connector body 371 configured so as to penetrate the upper surface 313 of the second cabinet 31 so as to be pushed by the first connection piece 318, a circuit connection piece 373 provided on the connector body 371 for opening or closing the first circuit L1, and an elastic support piece 375 for pushing the circuit connection piece 373 in the direction in which the circuit connection piece 373 moves away from the first circuit L1.

For example, referring to FIG. 2, when the connector body 371 is not pushed by a separate device provided in the first treatment device 1, but pushed by the first connection piece 318 provided on the bottom surface of the first treatment device 1, the cabinet fastener B may further include a connector receiving portion 317 in which the connector body 371 is received. The connector receiving portion 317 may be formed in the fastener body 314.

In some implementations, the connector 37 may be provided so as to open or close the second power line 39, and may be provided so as to open or close a control circuit L4, which connects the second controller C2 and the constituent elements 361, 373, 372 and 325*b* to each other.

The remote controller 5 is configured to remotely control the first treatment device 1 or the second treatment device 3. The remote controller 5 may control the second treatment device 3 will be described by way of example.

Referring back to FIG. 1, the remote controller 5 includes a body 51, a transmitter 52 provided in the body 51 for transmitting a control signal, and a receiver 513 provided in the second treatment device 3 for receiving the control signal from the transmitter 52.

Although the body 51 is separated from each of the first cabinet 11 and the second cabinet 31, the body 51 may be coupled to at least one of the first cabinet 11 or the second cabinet 31 using a fixing member 59.

That is, when the first cabinet 11 and the second cabinet 31 are formed of metals, the fixing member 59 may be a permanent magnet provided on the surface of the body 51 or provided in the body 51.

The receiver 513 serves to receive the control signal from the transmitter 52 and to transmit the same to the second controller C2. The receiver 513 may be provided in at least one of the drawer panel 323 and the drawer body 321.

When the receiver 513 is provided in the drawer panel 323, the receiver 513 may be provided on the front surface of the drawer panel 323 or the upper surface of the drawer panel 323.

When the receiver 513 is provided on the front surface of the drawer panel 323, the receiver 513 may be exposed to the outside of the drawer panel 323 as illustrated in FIG. 1, or may not be exposed to the outside of the drawer panel 323.

Figure 4B:
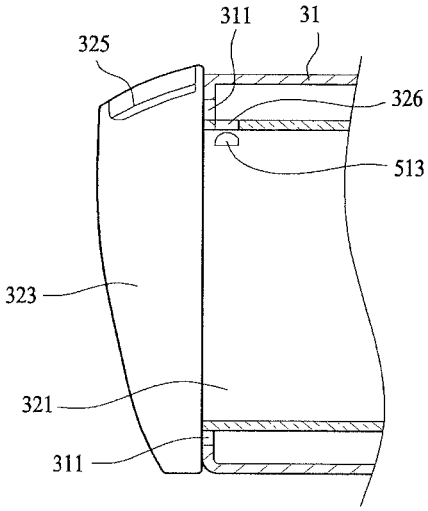

FIGS. 4(*a*) and 4(*b*) illustrate example receivers. In some implementations, referring to FIG. 4(*a*), when the receiver 513 is provided on the upper surface of the drawer panel 323, the receiver 513 may be provided on the second control panel 325.

In some implementations, referring to FIG. 4(*b*), when the receiver 513 is provided in the drawer body 321, the receiver 513 may be provided under a window 326, which transmits light into the drawer 32. The window 326 may be provided in a third hole formed in the upper surface of the drawer body 321, and the receiver 513 may be oriented in such a manner that a receiving surface for receiving radio waves faces the window 326.

For example, when the receiver 513 is provided in the drawer body 321, the control signal transmitted from the transmitter 52 may be scattered in a space between the upper surface of the second cabinet 31 and the upper surface of the drawer 32. One or more antennae of the receiver 513 can be directed to the upper surface of the second cabinet 31 to increase the efficiency of receiving the control signal.

In some implementations, as exemplarily illustrated in FIG. 1, the remote controller 5 may include a power supply unit 53 for causing the transmitter 52 to transmit a control signal for the supply of power to the second treatment device 3, and a course input unit 55 for causing the transmitter 52 to transmit a control command for the selection of a course, which is set in the second treatment device 3.

For example, when a plurality of courses is set in the second treatment device 3, a plurality of course input units 55 may be provided. That is, the course input units 55 may include a first course input unit 55*a* for the selection of a first course, a second course input unit 55*b* for the input of a second course, and a third course input unit 55*c* for the input of a third course.

In addition, the body 51 may be further provided with an execution request unit 56 for requesting the execution of a course selected by the course input unit 55 or the temporary stoppage of the course being executed. The execution request unit 56 may be provided so as to repeat the execution of the selected course and the stoppage of the course being executed whenever the user pushes the execution request unit 56.

In some implementations, the remote controller 5 may further include a discharge controller 57 for controlling the discharge unit 33 provided in the drawer 32 and a lock controller 58 for controlling the door lock 344.

The discharge controller 57 serves to control the operation of the motor used to rotate the pinion 333. The motor may be provided so as to repeat an operation of moving the drawer 32 to the outside of the second cabinet 31 and an operation of moving the drawer 32 into the second cabinet 31 whenever the user pushes the discharge controller 57.

The lock controller 58 serves to control the door lock 344 so as to fix the second treatment device door 348 to the second tub 34, or to cause the second treatment device door 348 to be separable from the second tub 34. The door lock 344 may be provided so as to repeat an operation of fixing the second treatment device door 348 to the second tub 34 and an operation of causing the second treatment device door 348 to be separable from the second tub 34 whenever the user pushes the lock controller 58.

In some implementations, the receiver 513 described above may be provided so as to receive a control signal regardless of whether or not the first treatment device 1 is seated on the upper surface of the second treatment device 3.

In FIG. 3, the elements 361, 373, 372 and 325*b*, which receive power via the first circuit L1, are provided so as to receive power only when an external object, such as the first treatment device 1, applies a pressure to the connector 37, whereas the second controller C2, the display unit 325*a*, and the receiver 513 may be provided so as to receive power from a power source regardless of whether or not the connector 37 is operated.

Even if the receiver 513 is provided so as to receive power from the power source regardless of whether or not the connector 37 is operated, no power may be supplied to the second drive unit 36 and other elements 373, 372 and 325*b* unless the first treatment device 1 is seated on the upper surface of the second treatment device 3. Accordingly, the second treatment device 3 may not be operated in the state in which the first treatment device 1 is not seated on the upper surface of the second treatment device 3.

When the receiver 513 receives a control signal indicating that the first treatment device 1 is not seated on the upper surface of the second treatment device 3, the second controller C2 may provide a notification, which indicates that the first circuit L1 is opened, to the display unit 325*a*.

Accordingly, the reason why the second treatment device 3 is not operated when the user operates the remote controller 5 in the state in which the first treatment device 1 is not seated on the upper surface of the second treatment device 3 may be displayed on the display unit 325*a* (using, for example, character signals, symbols, sound signals, or light emitting signals), and thereby it is possible to prevent a problem in which the user suspects the failure of the second treatment device 3 or the remote controller 5.

Alternatively, unlike the above description, the receiver 513 may be provided so as to transmit a control signal to the second controller C2 only when the first treatment device 1 is seated on the upper surface of the second treatment device 3.

For example, the receiver 513 may be provided so as to receive power via the first circuit L1. Accordingly, the receiver 513 may receive a control signal transmitted from the transmitter 52 only when the first treatment device 1 is seated on the upper surface of the second treatment device 3.

The above-described effect may be realized as the connector 37 is provided so as to open or close not only the control circuit L4, but also a control circuit L5, which connects the receiver 513 and the second controller C2 to each other.

In some implementations, at least one of the first treatment device 1 and the second treatment device 3 may serve to dry laundry. When the first treatment device 1 is used to dry laundry, the first tub 13 for the storage of water may be omitted. When the second treatment device 3 is used to dry laundry, the second tub 34 may be omitted. As is apparent from the above description, the present invention may have the effect of providing a laundry treatment apparatus in which a plurality of treatment devices each having a laundry treatment function (e.g. washing of laundry or drying of laundry) are stacked one above another so as to realize a complex laundry treatment function.

In addition, the present invention may have the effect of providing a laundry treatment apparatus in which a plurality of treatment devices are stacked one above another in such a manner that any one treatment device absorbs vibration generated in another treatment device, thereby minimizing vibration and noise.

In addition, the present invention may have the effect of providing a laundry treatment apparatus in which a plurality of treatment devices are stacked one above another to realize a complex function, at least one of the treatment devices being remote-controllable.

In addition, the present invention may have the effect of providing a laundry treatment apparatus in which a plurality of laundry treatment devices are stacked one above another to realize a complex function, the laundry treatment apparatus being capable of controlling, for example, a command to operate a drawer provided in a lower treatment device and a command to open and close a door from a remote place.

The invention claimed is:

1. A laundry treatment apparatus comprising:

a first cabinet;

a first drum located inside the first cabinet for receiving laundry therein;

a first drive unit configured to rotate the first drum;

a first controller configured to control the first drive unit;

a second cabinet that is configured to be located under the first cabinet and that defines an introduction/discharge opening;

a drawer configured to discharge from the second cabinet through the introduction/discharge opening;

a second drum located inside the drawer and configured to receive laundry therein;

a second drive unit configured to rotate the second drum;

a second controller configured to control the second drive unit;

a first connection piece disposed on a bottom surface of the first cabinet;

a remote controller configured to transmit a control signal to the second controller via wireless communication; and a connector configured to open and close a power circuit that is configured to supply power to the second drive unit, wherein the connector is further configured to:

based on the first cabinet being seated on an upper surface of the second cabinet, close the power circuit to allow operation of the second drive unit, and based on the first cabinet not being seated on the upper surface of the second cabinet, open the power circuit to prevent operation of the second drive unit, and wherein the connector includes a connector body that penetrates the upper surface of the second cabinet and that allows the first connection piece to apply a pressure to the connector body, and a circuit connection piece configured to open and close the power circuit.

2. The laundry treatment apparatus according to claim 1, wherein the drawer includes a drawer panel configured to open and close the introduction/discharge opening and a drawer body, to which the drawer panel is fixed, the drawer body being configured to be discharged from the second cabinet through the introduction/discharge opening, and wherein the remote controller includes a body, a transmitter disposed in the body and configured to transmit the control signal, and a receiver disposed in the drawer panel and configured to receive the control signal.

3. The laundry treatment apparatus according to claim 2, wherein the receiver is provided on a front surface of the drawer panel or an upper surface of the drawer panel.

4. The laundry treatment apparatus according to claim 1, wherein the drawer includes a drawer panel configured to open and close the introduction/discharge opening and a drawer body, to which the drawer panel is fixed, the drawer body being configured to be discharged from the second cabinet through the introduction/discharge opening, and wherein the remote controller includes a body, a transmitter disposed in the body and configured to transmit the control signal, and a receiver disposed in the drawer body and configured to receive the control signal.

5. The laundry treatment apparatus according to claim 4, further comprising a window disposed on an upper surface of the drawer body and configured to transmit light into the drawer, wherein the receiver is located under the window.

6. The laundry treatment apparatus according to claim 1, further comprising a fixing unit configured to separably couple the remote controller to the first cabinet or the second cabinet.

7. The laundry treatment apparatus according to claim 6, wherein at least one of the first cabinet and the second cabinet is made of a metal, and the fixing unit comprises a permanent magnet.

8. The laundry treatment apparatus according to claim 1, further comprising:

a discharge unit configured to move the drawer to an outside of the second cabinet or an inside of the second cabinet; and a discharge controller disposed in the remote controller and configured to control whether or not to operate the discharge unit.

9. The laundry treatment apparatus according to claim 1, further comprising:

a door configured to open and close an introduction opening, through which laundry is supplied to the second drum;

a door lock configured to fix the door to the introduction opening; and a lock controller disposed in the remote controller and configured to control whether or not to operate the door lock.

10. The laundry treatment apparatus according to claim 1, further comprising:

a second connection piece disposed on the upper surface of the second cabinet and configured to be separably coupled to the first connection piece.

11. The laundry treatment apparatus according to claim 1, wherein the second drive unit is configured to operate when the connector closes the power circuit, and wherein the second controller is configured to receive a control signal from the remote controller.

12. The laundry treatment apparatus according to claim 1, wherein the connector is further configured to, based on the first cabinet being lifted from the upper surface of the second cabinet, open the power circuit to prevent operation of the second drive unit.

13. A laundry treatment apparatus comprising:

a first cabinet;

a first drum located inside the first cabinet for receiving laundry therein;

a first drive unit configured to rotate the first drum;

a first controller configured to control the first drive unit;

a second cabinet that is configured to be located under the first cabinet and that defines an introduction/discharge opening;

a drawer configured to discharge from the second cabinet through the introduction/discharge opening;

a second drum located inside the drawer and configured to receive laundry therein;

a second drive unit configured to rotate the second drum;

a second controller configured to control the second drive unit;

a remote controller configured to transmit a control signal to the second controller via wireless communication;

a receiver disposed in the second cabinet or the drawer, the receiver being configured to receive the control signal from the remote controller and transmit the control signal to the second controller;

a connector configured to open and close a power circuit that is configured to supply power to the second drive unit;

a second treatment device power line that connects a power source and the power circuit to each other; and a display unit provided in the drawer, wherein the connector is further configured to:

based on the first cabinet being seated on an upper surface of the second cabinet, close the power circuit to allow operation of the second drive unit, and based on the first cabinet not being seated on the upper surface of the second cabinet, open the power circuit to prevent operation of the second drive unit, and wherein the second controller, the display unit, and the receiver are configured to receive power from the second treatment device power line so that the second controller, the display unit, and the receiver receive power regardless of whether or not the first cabinet is located above the second cabinet.

14. The laundry treatment apparatus according to claim 13, wherein the second controller is configured to notify a user of a state in which the power circuit is opened via the display unit when the receiver receives the control signal in a state in which no power is supplied to the second drive unit.

15. A laundry treatment apparatus comprising:

a first cabinet;

a first drum located inside the first cabinet for receiving laundry therein;

a first drive unit configured to rotate the first drum;

a first controller configured to control the first drive unit;

a second cabinet that is configured to be located under the first cabinet and that defines an introduction/discharge opening;

a drawer configured to discharge from the second cabinet through the introduction/discharge opening;

a second drum located inside the drawer and configured to receive laundry therein;

a second drive unit configured to rotate the second drum;

a second controller configured to control the second drive unit;

a remote controller configured to transmit a control signal to the second controller via wireless communication; and a connector configured to open and close a control circuit that connects the second controller and the second drive unit, wherein the connector is further configured to:

based on the first cabinet being seated on an upper surface of the second cabinet, close the control circuit to allow operation of the second drive unit, and based on the first cabinet not being seated on the upper surface of the second cabinet, open the control circuit to prevent operation of the second drive unit.

16. The laundry treatment apparatus according to claim 15, wherein the second drive unit is configured to operate when the connector closes the control circuit, and wherein the second controller is configured to receive a control signal from the remote controller.

17. The laundry treatment apparatus according to claim 15, wherein the connector is further configured to, based on the first cabinet being lifted from the upper surface of the second cabinet, open the control circuit to prevent operation of the second drive unit.

* * * * *